United States Patent [19]

Häusler et al.

[11] Patent Number: 4,730,791

[45] Date of Patent: Mar. 15, 1988

[54] ARRANGEMENT OF THE WORKING GAP OF A CRUSHING MACHINE HAVING A HORIZONTALLY DISPOSED HAMMER CRUSHER ROTOR

[75] Inventors: Dietrich Häusler, Vellmar; Dimitrios Kottis, Espenau, both of Fed. Rep. of Germany

[73] Assignee: Thyssen Industrie Aktiengesellschaft, Essen, Fed. Rep. of Germany

[21] Appl. No.: 791,220

[22] Filed: Oct. 25, 1985

[30] Foreign Application Priority Data

Aug. 29, 1984 [DE] Fed. Rep. of Germany ..... 3431658

[51] Int. Cl.[4] ..... B02L 13/26; B02L 13/282

[52] U.S. Cl. ..... 241/189 R; 241/239; 241/285 R; 241/285 A; 241/285 B; 241/287

[58] Field of Search ..... 241/189 R, 189 A, 187, 241/190, 239, 285 R, 286, 287, 288, 289, 290

[56] References Cited

U.S. PATENT DOCUMENTS

| | | | |
|---|---|---|---|
| 3,346,201 | 10/1967 | Butler, Sr. | 241/189 R |
| 3,659,794 | 5/1972 | Hemesath | 241/286 X |
| 3,910,510 | 10/1975 | Danberg | 241/189 R |
| 4,083,502 | 4/1978 | Dittman | 241/189 R |
| 4,177,954 | 12/1979 | Ostreng | 241/189 R X |
| 4,226,375 | 10/1980 | Cameron | 241/189 R X |
| 4,542,856 | 9/1985 | Adolph | 241/189 R X |

FOREIGN PATENT DOCUMENTS

| | | | |
|---|---|---|---|
| 3017437 | 11/1981 | Fed. Rep. of Germany . | |
| 2154470 | 9/1985 | United Kingdom | 241/189 R |

*Primary Examiner*—Timothy V. Eley

*Attorney, Agent, or Firm*—Becker & Becker, Inc.

[57] ABSTRACT

An arrangement of the working gap of a crushing machine having a housing in which is disposed a hammer crusher rotor via a horizontally disposed shaft. The working gap is disposed between the striking circle described by the hammers of the rotor as the latter rotates, and the bottom, trough-like inner housing surface that faces the rotor. The housing has an outlet for material that has been reduced in size, with the outlet extending tangential relative to the rotor. The housing also has an inlet that is provided with an anvil, and extends approximately radially relative to the rotor. The entire width of the working gap, when viewed in the direction of rotation of the rotor, is crescent-shaped from the anvil at the inlet to the tangential outlet.

6 Claims, 4 Drawing Figures

ARRANGEMENT OF THE WORKING GAP OF A CRUSHING MACHINE HAVING A HORIZONTALLY DISPOSED HAMMER CRUSHER ROTOR

BACKGROUND OF THE INVENTION

1. Field of the Invention

The present invention relates to an arrangement of the working gap of a crushing machine having a housing in which is disposed a hammer crusher rotor via a horizontally disposed shaft. The working gap is disposed between the striking circle described by the hammers of the rotor as the latter rotates, and the bottom, trough-like inner housing surface that faces the rotor. The housing has an outlet for material that has been reduced in size, with this outlet extending tangential relative to the rotor. The housing also has an inlet that is provided with an anvil, and extends approximately radially relative to the rotor.

2. Description of the Prior Art

A crushing machine of the aforementioned general type is disclosed, for example, in German Offenlegungsschrift No. 30 17 437 -Linnerz published Dec. 11, 1981. With such machines, which are predominantly utilized for reducing the size of metallic scrap, non-metallic material, or a mixture of the two, the working gap, which is disposed between the striking circle of the rotor striking hammers and the bottom, inner housing surface that faces the rotor, and which starts at an anvil on the inlet side, has a uniform height over its entire length when viewed in the direction of rotation of the rotor. There occurs, especially when the striking hammers or the anvil at the inlet side is worn, that from the material which is to be reduced in size larger pieces of material are knocked off, become wedged in the working gap, and block the passage, so that material which follows accumulates at this location in the bottom, trough-shaped housing section, where it gradually builds up and fills the working gap. The forces which act upon the surface of the rotor as a result of the material trapped in the working gap cause great wear not only at the surface of the rotor but also at the rotor support.

An object of the present invention, with a crushing machine on the aforementioned general type, is to provide the working gap between the surface of the rotor and the trough-shaped inner surface of the housing with such a configuration that wedging of material which is to be reduced in size, and the wear caused thereby, are avoided.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
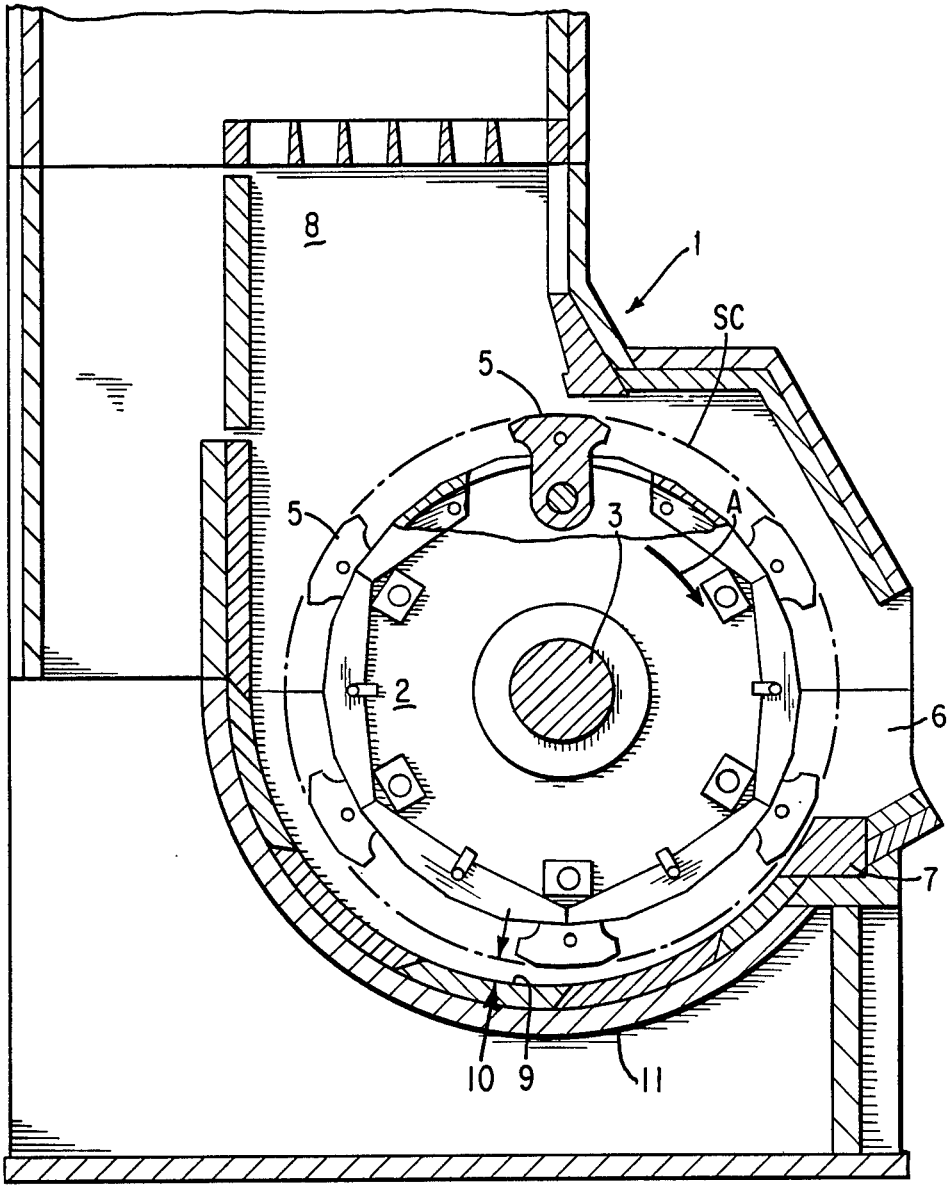
FIG. 1 is a cross sectional view through a crushing machine having a horizontally disposed hammer crusher rotor and the inventive working gap.

The arrangement of the present invention is characterized primarily in that the entire width of the working gap, when viewed in the direction of rotation of the hammer crusher rotor, is crescent-shaped from the anvil at the inlet to the tangential outlet.

As a result of the combination of the inventively provided features, not only is the wear at the rotor and its support positions considerably reduced, but also a spacing between the striking circle of the rotor hammers and the anvil on the inlet side is achieved that remains constant over a longer period of time, thus assuring a frictionless reduction of the size of the material. Since the bottom, trough-shaped housing section can be made pivotable, and the support of the rotor shaft can be moved in the vertical or horizontal direction, there is provided between the striking circle of the rotor hammers and the trough-shaped inner surface of the housing a working gap that constantly increases in height from the anvil on the inlet side when viewed in the direction of rotation of the rotor. This results in the achievement of a greater throughput.

A further advantage of the present invention is that due to the vertical or horizontal adjustment of the support of the rotor shaft, the rotor striking hammers and the anvil that cooperates therewith remain uniformly effective, as when they are new, over longer time periods despite wear.

Further specific features of the present invention will be described subsequently.

DESCRIPTION OF PREFERRED EMBODIMENTS

Referring now to the drawings in detail, the crushing machine essentially comprises a two-part housing 1, and a horizontally disposed hammer crusher rotor 2; both ends of the shaft 3 of the rotor 2 are mounted in a support housing 4 (FIGS. 3 and 4), and the shaft 3 is connected with a non-illustrated drive mechanism. The hammer crusher rotor 2 is provided with a number of hammers 5 that are uniformly distributed over the periphery thereof at a radial distance from the shaft 3; the hammers 5 are rotatably mounted about respective shafts. When the rotor 2 rotates, these hammers 5 describe an impact or striking circle that with new hammers is indicated by the dot-dash circle SC. The direction of rotation of the hammer crusher rotor 2 is indicated by the arrow A. Material which is to be crushed or reduced in size is introduced into the housing 1 via an inlet 6 that is disposed nearly radial to the hammer crusher rotor 2, and at the end of which is disposed an anvil 7. Pieces of material are severed at the anvil 7 by the striking hammers 5 of the rotor 2. After the size reduction in the machine, the crushed material is ejected or discharged from the housing 1 via an outlet 8 that extends tangentially relative to the hammer crusher rotor 2. A working gap 10 is located between the striking circle SC of the rotor hammers 5, and the bottom, trough-shaped inner housing surface 9, which faces the rotor 2. When viewed in the direction of rotation A of the rotor, the working gap 10 is crescent-shaped, and has a height that constantly changes from the anvil 7 toward the outlet 8 for the material.

Figure 2:
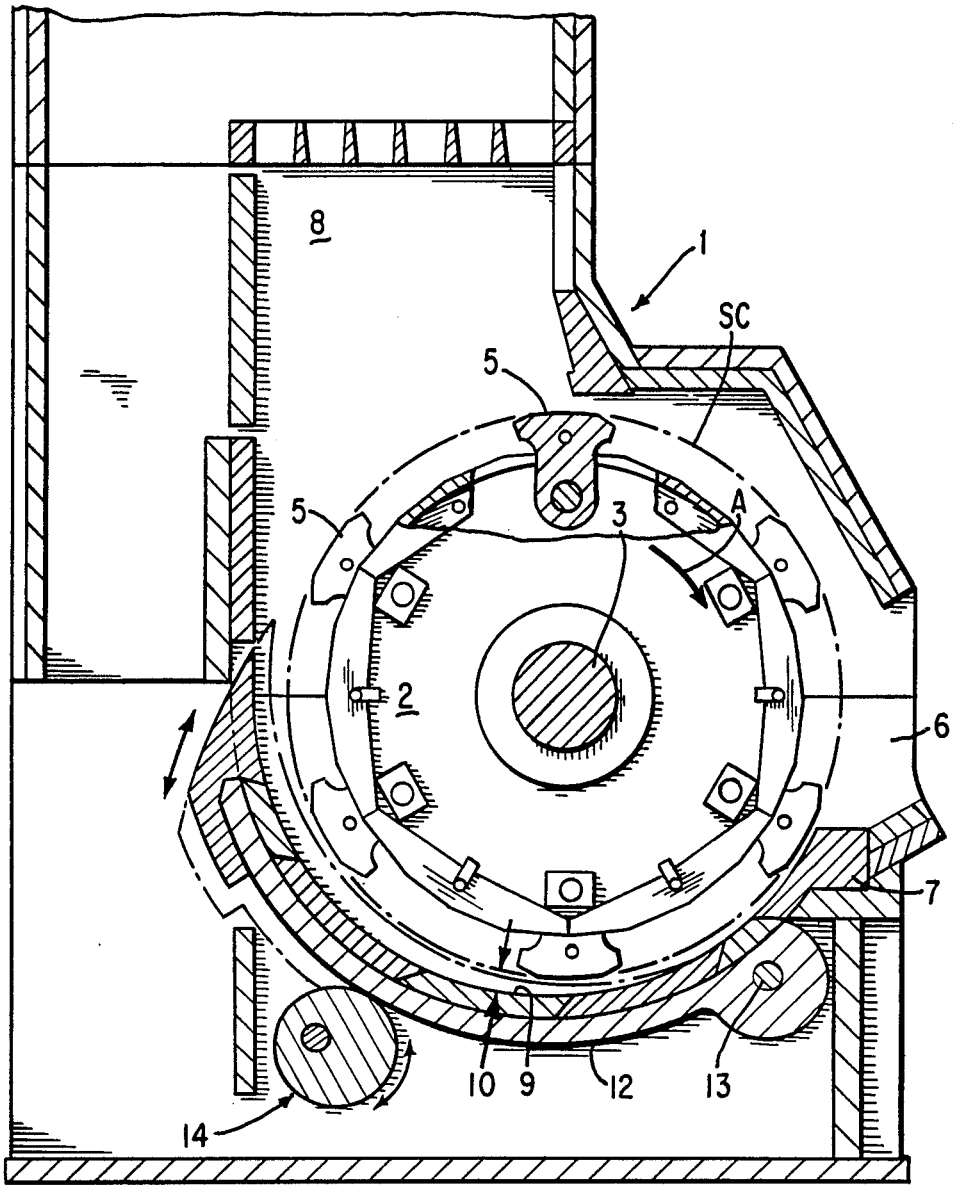
FIG. 2 is a cross sectional view in conformity with that shown in FIG. 1, and illustrates a special embodiment of the inventive working gap.

In the embodiment illustrated in FIG. 2, the crescent-shaped working gap 10 is adjustable via a section 12 that is pivotably mounted in the bottom trough-like portion 11 of the housing in such a way that it can be ra.ıed.

The pivotal movement of the bottom section 12 is effected about a shaft 13 disposed parallel to the rotor shaft 3 in the vicinity of the anvil 7; this pivotal movement is carried out by an independent lifting element 14 that is known per se, such as an eccentric mechanism. With this inventive construction, the rotor shaft 3 can pass through the center of the two side walls of the housing 1. However, it is equally possible to adjust the desired working gap 10, especially in the vicinity of the anvil 7 on the inlet side, by vertically or horizontally adjusting the support housing 4.

Thus, the bottom, trough-like portion 11 of the housing 1 is provided with a bottom section 12 that is pivotably supported on the shaft 13 disposed parallel to the rotor shaft 3 in the vicinity of the anvil 7; the independent lifting element 14 is provided for raising and lowering the pivotable bottom section 12 of the bottom housing portion 11.

Figure 3:
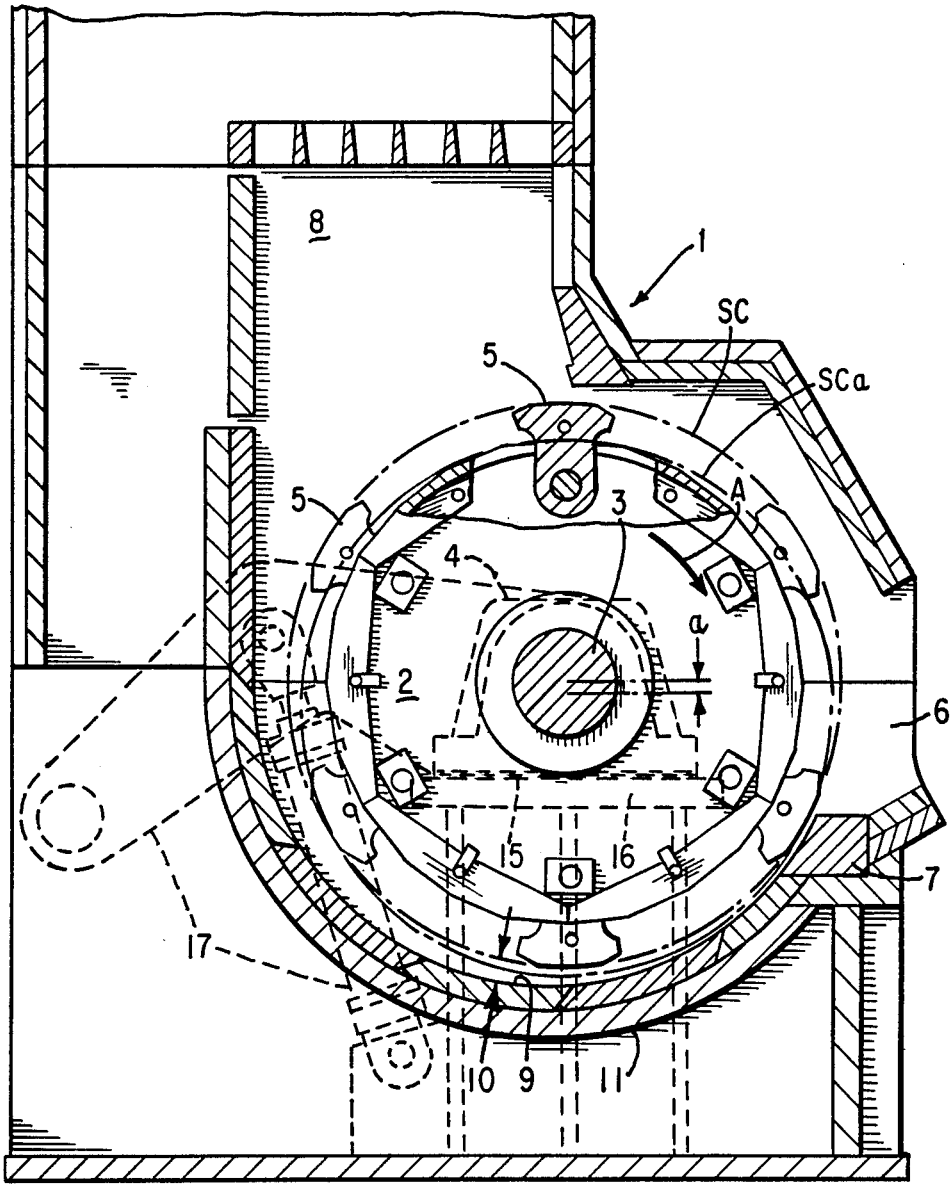
FIGS. 3 and 4 are each cross sectional views as in FIG. 1, and illustrate modified embodiments of the inventive working gap.

FIG. 3 illustrates an inventive embodiment where the housing bottom 11 is embodied in one piece, and the height adjustment "a" of the support housing 4 for the rotor shaft 3, for example, can be carried ou by removing or inserting spacers 15 between the support housing 4 and the associated support bracket 16. A pivot mechanism 17 having a piston/cylinder unit is indicated in dashed lines and is provided for raising and lowering the support housing 4 in order to provide a precise adjustment of the position of the latter. By lowering the support housing 4 for the rotor shaft 3, the working gap 10 can be appropriately adapted to the existing conditions when the rotor hammers 5 and the anvil 7 are partially worn or used up. The impact or striking circle of worn rotor hammers 5 is indicated by the smaller striking circle SCa.

Thus, the support bracket 16 for the support housing 4 associated therewith furthermore also includes, for the purpose of changing the height of said support housing 4, spacers 15 that can be selectively inserted and removed from between the support housing 4 and the support bracket 16 to effect vertical alteration of the position of the support housing 4 and hence of the rotor shaft 3.

Figure 4:
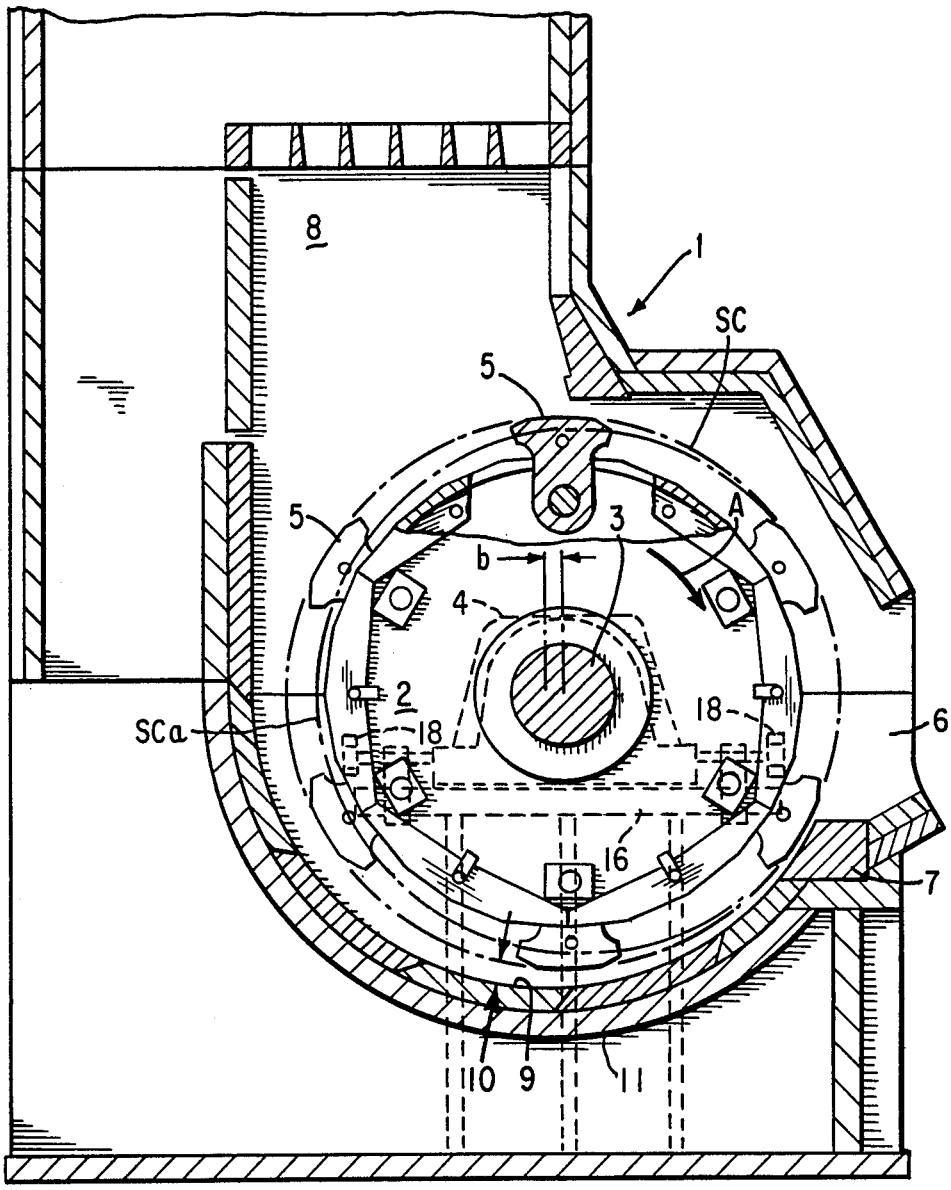

FIG. 4 shows a further embodiment with a onepiece housing bottom 11. In this embodiment, the support housing 4 for the rotor shaft 3 can be horizontally displaced on its associated support bracket 16 via special mechanisms, and can be fixed in the desired position. For this purpose, two oppositely disposed mechanisms 18 are associated with each support housing 4. The amount of displacement is indicated in FIG. 4 by the letter "b". The height of the crescent-shaped working gap 10 can either be fixed, or can be adjusted during rotation of the rotor 2. The size at the beginning of the crescent-shaped working gap 10, i.e. between the rotor hammer striking circle SC or SCa and the anvil 7 at the inlet side, is, of course, crucial for the size of the material pieces which are to be knocked off, and hence is also crucial for the change of position of the rotor support housing 4. The size of the working gap 10, at least in the vicinity of the anvil 7, is monitored by a non-illustrated measuring device which is known per se, such as a stroboscope.

The arrangement of FIG. 4 thus includes two diametrically oppositely disposed displacement mechanisms 18 for changing and fixing the horizontal position of the support housing 4, and hence of the rotor shaft 3.

The present invention is, of course, in no way restricted to the specific disclosure of the specification and drawings, but also encompasses any modifications within the scope of the appended claims.

What we claim is:

1. In an arrangement including a working gap of a crushing machine having a housing in which is disposed a hammer crusher rotor including hammers thereon describing a striking circle via a horizontally disposed shaft on which said rotor is rotatably mounted; said working gap being disposed between the striking circle described by the hammers of said rotor as the latter rotates, and a bottom, trough-like inner housing surface that faces said rotor; said housing having an outlet for passage of material that has been comminuted and reduced in size by the hammers of said rotor, with said outlet extending tangential relative to said rotor; said housing also having an inlet that is provided with an anvil, with said inlet for material extending approximately radially relative to said rotor;

the improvement therewith wherein an entire width of said working gap, when viewed in the direction of rotation of said hammer crusher rotor, is crescent-shaped, said working gap having a height that constantly changes in a path extending from said anvil at said inlet to said tangential outlet for the material.

2. An arrangement according to claim 1, which includes support housing means for said shaft of said rotor; for the purpose of changing the size of said crescent-shaped working gap, the position of said support housing means is alterable relative to at least one of said anvil and said bottom, trough-like inner surface of said housing.

3. An arrangement according to claim 2, in which said bottom, trough-like portion of said housing is provided with a section that is pivotably supported on a shaft disposed parallel to said rotor shaft in the vicinity of said anvil; and which includes an independent lifting element for raising and lowering said pivotable section of said bottom housing portion.

4. An arrangement according to claim 3, in which said lifting element includes a rotatable eccentric mechanism that cooperates with said pivotably supported section of said bottom housing portion.

5. An arrangement according to claim 2, which includes two diametrically oppositely disposed displacement mechanisms for changing and fixing the horizontal position of said support housing means, and hence of said rotor shaft.

6. In an arrangement including a working gap of a crushing machine having a housing in which is disposed a hammer crusher rotor including hammers thereon describing a striking circle via a horizontally disposed shaft on which said rotor is rotatably mounted; said working gap being disposed between the striking circle described by the hammers of said rotor as the latter rotates, and a bottom, trough-like inner housing surface that faces said rotor; said housing having an outlet for passage of material that has been comminuted and reduced in size by the hammers of said rotor, with said outlet extending tangential relative to said rotor; said housing also having an inlet that is provided with an anvil, with said inlet for material extending approximately radially relative to said rotor;

the improvement therewith wherein an entire width of said working gap, when viewed in the direction of rotation of said hammer crusher rotor, is crescent-shaped in a path extending from said anvil at said inlet to said tangential outlet; support housing means for said shaft of said rotor; for the purpose of changing the size of said crescent-shaped working gap, the position of said support housing means is alterable relative to at least one of said anvil and said bottom, trough-like inner surface of said housing; support bracket means for said support housing means, and also, for the purpose of changing the height of said support housing means, spacers that can be selectively inserted and removed from between said support housing means and said support bracket means to effect vertical alteration of the position of said support housing means and hence of said rotor shaft.

* * * * *